US005342042A

United States Patent [19]

Candy et al.

[11] Patent Number: 5,342,042

[45] Date of Patent: Aug. 30, 1994

[54] BALL LOCATION SYSTEM

[75] Inventors: Bruce H. Candy, Basket Range; John R. Baxter, Salisbury Heights, both of Australia

[73] Assignee: Caldone Pty. Limited, Camden Park, Australia

[21] Appl. No.: 837,085

[22] Filed: Feb. 18, 1992

Related U.S. Application Data

[63] Continuation of Ser. No. 458,669, Feb. 16, 1990, abandoned.

[30] Foreign Application Priority Data

Jun. 30, 1987 [AU] Australia ..... PI2801

[51] Int. Cl.[5] ..... A63C 19/06

[52] U.S. Cl. ..... 273/31

[58] Field of Search ..... 273/31, 29 A, 411; 340/323

[56] References Cited

U.S. PATENT DOCUMENTS

| | | | |
|---|---|---|---|
| 3,415,517 | 12/1968 | Krist | 273/31 |
| 3,774,194 | 11/1973 | Jokay | 273/31 |
| 3,810,148 | 5/1974 | Karsten et al. | 340/323 R |
| 3,883,860 | 5/1975 | Kohorn | 273/31 |
| 3,896,248 | 7/1975 | Scarpa | 273/31 |
| 4,092,634 | 5/1978 | Kohorn | 273/31 |
| 4,109,911 | 8/1978 | Auken | 273/31 |
| 4,299,384 | 11/1981 | Van Auken | 273/58 G |
| 4,375,289 | 5/1983 | Schmall et al. | 340/323 R |
| 4,392,122 | 7/1983 | Hocken | 340/323 R |
| 4,527,152 | 7/1985 | Scarr et al. | 340/572 |
| 4,528,548 | 7/1985 | Oberan | 340/323 R |
| 4,664,376 | 5/1987 | Gray | 340/323 R |
| 4,664,378 | 5/1987 | Van Auken | 273/61 R |
| 4,814,987 | 3/1989 | Spielman | 273/31 |
| 4,840,377 | 6/1989 | Bowser | 273/31 |
| 4,859,986 | 8/1989 | Auken | 273/31 |
| 4,867,499 | 9/1989 | Carlton | 340/323 R |

OTHER PUBLICATIONS

Engineering Circuit Analysis, 1978. Located in Art Unit 3304 Library of Jessica Harris.

*Primary Examiner*—Theatrice Brown

*Attorney, Agent, or Firm*—Cushman, Darby & Cushman

[57] ABSTRACT

An arrangement to determine whether a tennis ball is "in" or "out" on a playing surface, which includes both a transmit coil and a receive coil beneath the playing surface and a modified tennis ball to have a non-zero magnetic permeability, so that an alternating signal can be transmitted from the transmit coil and re-radiated from the tennis ball, which can then be detected by the receive coils, and can be synchronously demodulated and resistive and reactive components of the signal analysed to discriminate the ball from other influences. The receive coils can be wound to avoid electro-magnetic interference from far fields.

14 Claims, 2 Drawing Sheets

BALL LOCATION SYSTEM

This is a continuation of application Ser. No. 07/458,669, filed on Feb. 16, 1990, which was abandoned upon the filing hereof.

This invention relates to a ball location arrangement and in particular to means to assess the position of a ball such as a tennis ball when this hits a playing surface in the vicinity of a court marking line.

BACKGROUND OF THE INVENTION

It is a well known problem to which there are several proposed solutions.

Systems utilizing balls containing conductive fibres which close circuits when making contact between exposed sensor conductors on the court surface, such as those described in the U.S. Pat. Nos. 3,883,860 and 4,299,384, have the problem that the balls may have to be of different colour, surface texture, friction coefficient, and moment of inertia than that of the now conventionally used tennis ball, and the court will necessarily be of substantially different texture near the lines. Furthermore the circuits may be closed by any electrical conductor such as an aluminium tennis racket, or conductive fibres which may have fallen out of the ball and lie across the sensing conductors on the court.

Systems utilizing electromagnetic interrogation by means of sensing coils buried below the court surface are described in U.S. Pat. Nos. 3,774,194 and 4,664,376.

The former patent describes a radio frequency bridge circuit, one "arm" of which comprises a buried coil, which is used to sense a tennis ball containing a resonant electrical circuit tuned to the radio frequency transmitted by the coil.

The latter patent describes a buried coil which is part of the resonator of an oscillator whose frequency and quality factor are altered by the close presence of a ball of substantially non-zero magnetic permeability.

There are difficulties with such an arrangement in so far that there is susceptibility to external influences. Furthermore, there is great difficulty to assess whether a ball touches the line in cases where the ball is either just "in" or "out"; rather; the described systems merely sense the close proximity of the ball to the sensing coils. In addition, the ball described in U.S. Pat. No. 3,774,194 has physical properties substantially different from a standard ball, such as moment of inertia which necessarily has distinct Elgen axes.

In order to determine whether the ball is "in" or "out", it is necessary to process the received data by means of pattern recognition algorithms or arithmetic algorithms of the data of the received pulse shape generated by the close passage of the ball. Merely measuring the close presence of a ball as indicated in U.S. Pat. No. 4,664,376 will result in inaccuracies for reasons given later.

It is an object of this invention to at least reduce one or more of the above difficulties.

SUMMARY OF THE INVENTION

According to one form of this invention there is provided a ball location assessment arrangement including, beneath a playing surface, a transmit coil, and a receive coil, the two coils being located in mutually adjacent alignment beneath a selected part of the playing court.

By preference, the respective coils are in adjacent alignment by reason of being in an overlapping relationship.

By preference, the receive coil is adapted by reason of its shape to effect a substantial self-canceling of signals received from far field sources.

By preference, there are two receive coils adjacent the transmit coil.

By preference, the receive coil includes a first part would in a first clockwise direction, and a second part wound in a counterclockwise direction, thereby to provide for substantial self-cancelling of any signals received from far field electromagnetic sources.

According to this invention, there is provided an electromagnetic interrogation system in which transmit and receive coils are located below the court surface in the vicinity of the court lines.

An axis of each of these coils is parallel to the court line, and signals from these coils are used to sense a ball with material with substantially non-zero magnetic permeability.

By preference, the ball has some of the latex rubber "filler" additives normally present in a tennis ball replaced with powdered particles of a highly permeable magnetic material such as a ferrite.

By preference, there are transmitter means which transmit through the transmit coil an alternating magnetic field with a period selected from within the range 2 micro-seconds to 200 micro-seconds, which signal may be received by the receive coil or coils from a ball re-radiating the signal together with extraneous effects.

By preference, signals induced in the receive coils are synchronously demodulated and low-pass filtered by detector means. The reference phases of the synchronous demodulators are selected to select magnetic components either in-phase with the ball's magnetic permeability or quadrature components to the ball's permeability. The low-pass filtered signals are then further processed by effecting a comparison of the signal with a known signal result to yield a final "in" or "out" assessment.

By preference, there are a plurality of individual receive coils each occupying a selected long length of a line beneath a playing surface that is a tennis court and, are preferably of the order of meters in elongate length. These said receive coils are preferably laid end-to-end below the length of the court lines, with a proportion of each end overlapping with its adjacent coils. The transmit coil may likewise be segmented, or extend the length of the lines.

The system described herein can overcome a number of the previously existing problems.

Firstly, physical differences:

The ball and court can be made to be physically indistinguishable from the heretofore standard balls and courts.

Secondly, false triggerings can be minimized where detectable objects other than the ball traverse the line.

Thirdly, reduced susceptibility to far field generated electromagnetic interference (E.M.I.).

Both the quadrature and in-phase signals are equally susceptible to electromagnetic interference. Thus, any significant signal in the quadrature channel indicates a false signal. If further the receive coil circuits are constructed so that far magnetic fields are canceled whereas near fields are not, then the system can be relatively insensitive to electromagnetic interference compared to systems containing coils not nulled to far fields.

Fourthly, accuracy:

The processing can include means for reasonably accurately determining whether any part of the ball touched the line in "just in/out" cases. This can be achieved by means of processing algorithms part of which require certain ratios or comparisons of signal values, not just magnitude comparisons to fixed values.

Furthermore, it is best that some of these said ratios or comparisons are between data from different receive coil circuits which are sensitive to the same length of court line, but which have different spatial sensitivities across the line. Processing utilizing data from two different coil signals enable the final "in"/"out" assessment to be relatively independent of the depth of the coils or permeability of the ball.

BRIEF DESCRIPTION OF THE DRAWINGS

To assist with the understanding of this invention, reference will now be made to attached drawings wherein.

DETAILED DESCRIPTION

Figure 1:
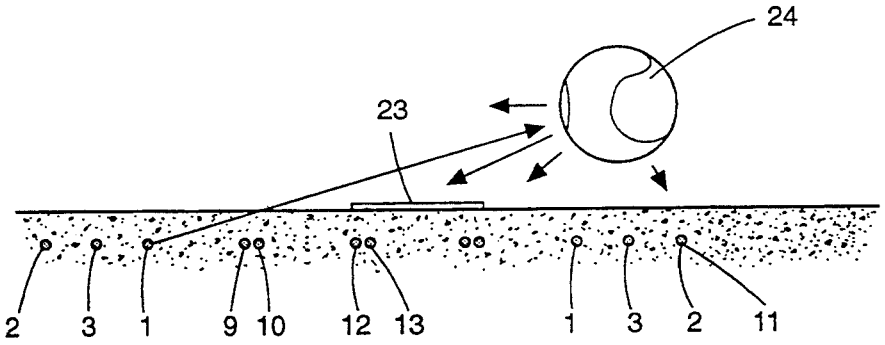
FIG. 1 is a diagram showing, according to the preferred embodiment, an arrangement of a transmit coil and two receive coils circuits balanced to far fields, and with uniform sensitivity at the ends.

Referring in particular to the drawings, there is shown a transmit coil 1 and receive coils 2 and 3. The receive coils 2 and 3 are two independent receive coil circuits with windings wound in both clockwise and anti-clockwise senses indicated by the arrows 4, 5 and 6 for coil 2, and 7 and 8 for coil 3. That is coil 2 effectively consists of three series windings 9, 10 and 11, one in a clockwise sense at the top of the diagram, followed by an anti-clockwise winding 10 in the center, and then followed by a clockwise winding at the bottom of the diagram.

Coil 3 effectively consists of two series windings 12 and 13, one of these, 12, being wound in a clockwise sense in the top half of the diagram, followed by an anti-clockwise winding 13 in the bottom half of the diagram.

The dimensions and number of turns of each winding are selected such that signals induced in each coil from far magnetic fields at the transmit frequency are substantially canceled or nulled. This substantially reduces the level of electromagnetic interference in the coil circuits. In this specification, reference to "far field" is understood to mean a field generated by a source at least ten times further from a receive coil than the width dimension of the coil.

The effect of the transmit coil's spatial impedance must be taken into account for the cancellation to be successful. For example, if the coils are symmetrically displaced about the centre of the diagram, coil 3, with the same number of turns in each winding, will be balanced to far fields regardless of the transmit coil's driving impedance, whereas, for the same dimensions, the number of turns in coil 2 outer coils 9 and 11 compared to the inner coil 10 is dependent on the transmit coil 1 driving impedance. The sensitivities of the coils to the ball 25 are highest at the ends of the receive coils.

In order to make the sensitivity more uniform, it is necessary to split each coil winding at the ends, as shown at 14.

Figure 3:
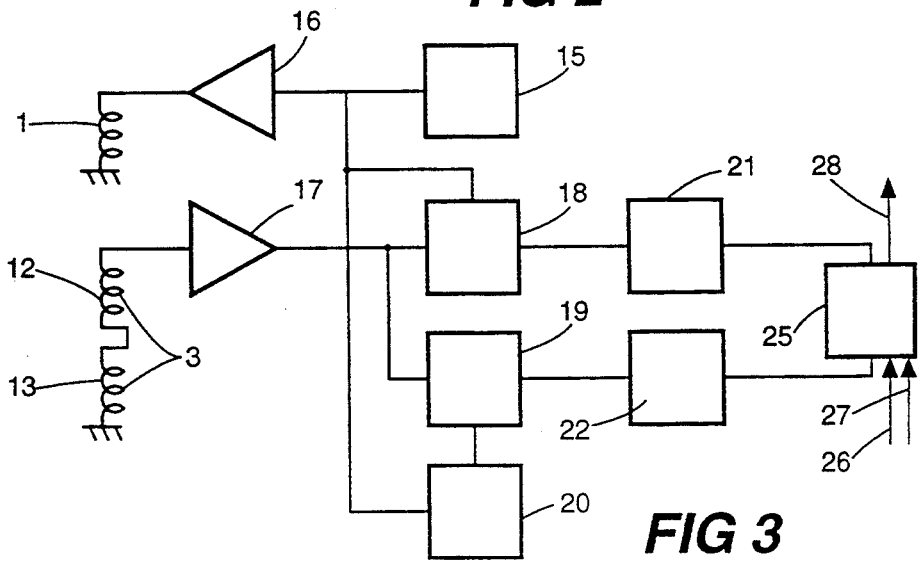
FIG. 3 shows a schematic circuit layout for the embodiment of FIGS. 1 and 2.
Figure 4A:
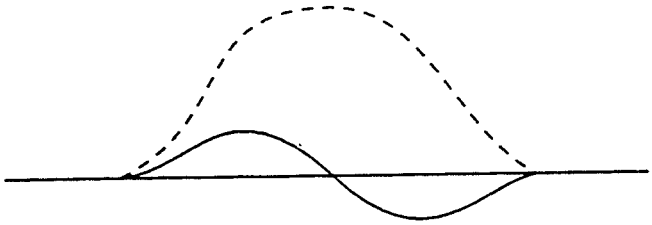
FIGS. 4(*a–d*) shows waveforms from balls of different trajectory striking the court above a buried coil system for the configuration shown in FIGS. 1, 2 and 3.
Figure 4B:
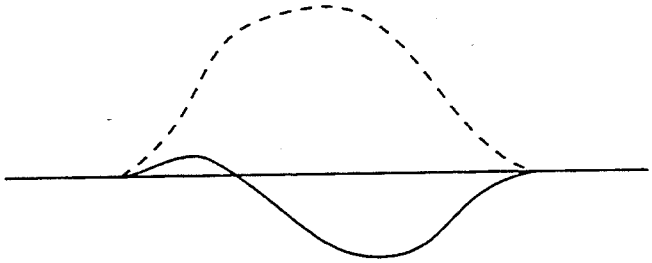
Figure 4C:
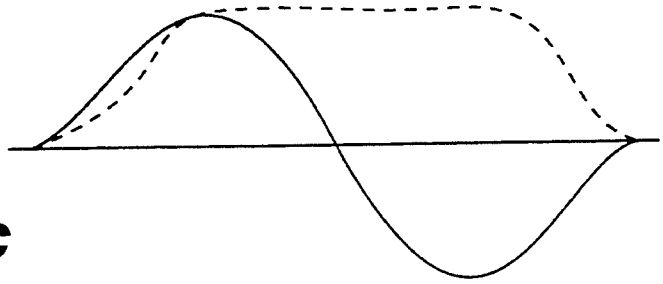
Figure 4D:
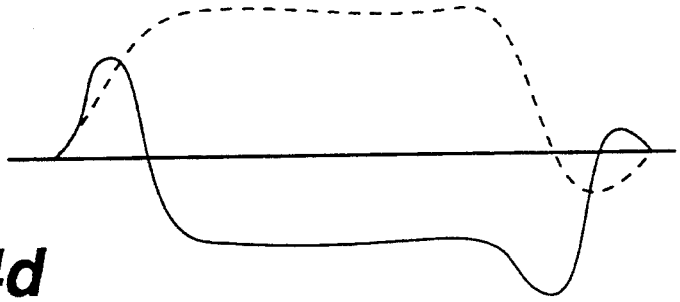

The signals generated by oscillator 15 are amplified through amplifier 16 and, when received in coils 2 and 3, are amplified by amplifier 17, then synchronously demodulated at the transmit frequency and then low-pass filtered. The synchronous demodulator reference phases are selected to select both components substantially in-phase with the ball's permeability and at quadrature to it, these being shown in FIG. 3 as synchronous demodulator and low pass filter 18 for in-phase components and synchronous demodulator and low pass filter 19 for quadrature phase components using a quadrature phase shifter 20.

A quiescent "background" signal is subtracted at 21 and 22 to give a signal whose magnitude is a function of changes in the magnetic environment of the coils. The in-phase components are used for further processing and the quadrature components can be used for discrimination purposes such as identifying materials with reactive-to-resistive ratios different from that of the ball, such as aluminium tennis rackets, metal tacks in tennis shoes, etc., traversing the court line, as well as discriminating against electromagnetic interference. Data from receive coil pairs are processed in a "local" microprocessor 25, and the processed information is passed to a "central" microprocessor as indicated by 28. A similar receiving and analogue processing circuitry are used for coil 2, and the corresponding data are passed to the common "local" microprocessor 25, as indicated by 26 and 27.

Accordingly, by introducing the concept of providing a transmit coil and a receive coil, it is possible to tailor the receive coil or coils to firstly be less susceptible to electromagnetic interference from distant sources or far fields, and it is also possible to effect a substantial discrimination, in that the received signal can then be examined in relation to its resistive and reactive components and only signals within selected limits can then be accepted.

A ball, and in particular a tennis ball, can have a small quantity of ferrite incorporated within the mixture of the rubber, replacing, to the same weight, previously existing fillers, so that the ball and its handling and bouncing characteristics remain absolutely the same, except that it has a substantive magnetic permeability.

The reason for using two receive coils is that if one receive coil only is used, for instance coil 3, if a tennis ball maintained a position exactly along a lateral dividing line of this coil, it would not appear to be detectable and hence one needs a separate further coil set to detect a ball in this situation.

The second receive coil, of course, has to also be wound so as to be essentially balanced or nulled against far field origin electromagnetic interference, but be differently wound from the first coil, that is coil 2, to achieve this.

Figure 2:
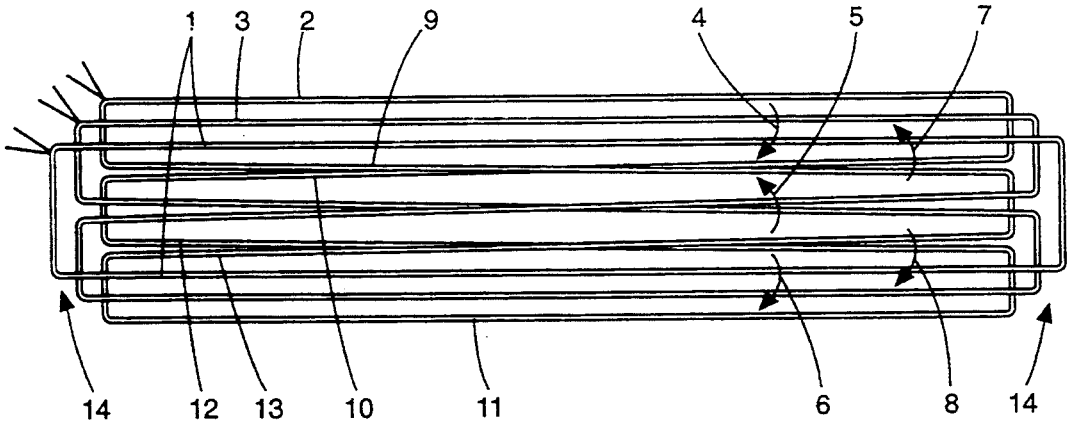
FIG. 2 is a plan view of the arrangement shown in FIG. 1.

The coils as aligned specifically in FIG. 2, can be of substantially indefinite lengths, but are then appropriately located beneath each of the respective lines, such as at 23, that one might expect on a tennis court.

Each receive coil is "nulled" to the transmitted field, that is the net signal induced by the transmit coil in either receive coil is substantially minimized owing to the selected geometry of the windings in relation to the transmit coil. This is conductive to relatively simple electronics not requiring high tolerances of stability and large dynamic range.

There will now be discussion as to how to interpret an "in" or "out" assessment, which can involve determining for a large number of different bounce positions, the appropriate signature for a ball, having this stored in the memory of a microprocessor, and then having this compare an appropriate signature with an incoming signal signature when the unknown position is to be determined.

While a significant signal is present in the quadrature component of either coil in a receive coil pair, all tennis ball "in" or "out" assessments need be inhibited for data from the coil pair. Thus, occasions may arise when the system is unable to assess whether a ball is "in" or "out", but these should be infrequent.

FIG. 4 shows four waveforms at the low pass filter output, with the background subtracted, from the in-phase components resulting from balls of different trajectory striking the court above a buried coil system of the configuration shown in FIGS. 1 and 2. The "dashed" lines represent the response from coil 2 and the "continuous" lines are for coil 3.

Assume that the "in/out" edge is directly above the boundary between the two windings in coil 3's circuit, that is the centre of FIG. 2, and that in each case the projection of the ball is traversing from the bottom of the page to the top, where the bottom is on the "in" side and the top on the "out" side.

Trajectories for balls from a "high lob" in which the ball strikes the court from a near vertical approach, which land exactly in the centre of the coil system, that is the ball is "in", and a little above centre such that the ball is just "out" are shown in 4(*a*) and 4(*b*), respectively.

Waveforms resulting from trajectories of a fast shot which just skims over the net, in which the ball strikes the court from a near horizontal approach, are shown in 4(*c*) and 4(*d*). 4(*c*) is for such trajectories where the ball's "foot print" is symmetrical about the "in"/"out" edge, and 4(*d*) is for such trajectories where the ball is just "out".

Many algorithms can be employed to determine whether the ball was "in" or "out". All reasonably accurate algorithms require either waveform comparisons with a dictionary of waveforms spanning a range of possible waveforms, or, algorithms in which certain ratios or comparisons of signal values with each other are made, not just magnitude comparisons to fixed values. For example, part of one such latter algorithm determines the value of $$(\int(S3+K\mathrm{abs}(S3))dt)/(\int S2dt)$$

where S2 and S3 are the low-passed signal with the quiescent signals removed from coil 2 and 3 respectively. "abs(S3)" means the absolute value of S3 and K is a constant. If the value is less than a certain constant, the ball is deemed to be "out", otherwise it is deemed to be "in", so long as certain other criteria are also met. Comparing data from one coil circuit in one pair with data from the other, yields a result relatively independent of the depth of the coils below the surface and ball permeability.

It is also desirable to check that the data are within certain constraints for further discrimination purposes. For example, too large or small a signal, or a pulse shape that could not have been created by an apparently impossible ball trajectory would necessitate an unacceptable assessment.

In cases where the ball lands near the line near the end of a receive coil pair and where part of the ball trajectory is too far outside of the receive coil pair's sensitive zone required for accurate ball position assessment, it is necessary to make an assessment as to whether the ball is "in" or "out" by examining data from the coil pair in question and the coil pair adjacent to it near which the ball also traverses.

For simplicity and accuracy, it is best to overlap the ends of adjacent receive coil pairs so that for the whole region near the line, all ball positions within the near field of the coils induce substantial signals usable for assessment in at least one coil. An assessment needs be made to determine whether detected and processed ball signals indicate that the ball is traversing near either end of any coil pair.

A "central microprocessor" is alerted to which processed data from each coil pair are transmitted, such that the said central micro-processor selects or combines the data from all the pair of coils near which the ball 24 traversed to yield a final assessment as to whether the ball 24 was "in" or "out".

In tennis courts containing metallic reinforcing rods, the magnetic field in the vicinity of the rods, is substantially altered by the presence of the rods owing to their permeability. Hence, the response to a ball traversing areas near the rods will be different from that of corresponding ball trajectories further from the rods.

In order to avoid this undesirable situation, a metal screen, made of aluminium, for example, may be inserted between the rods and the coils. The presence of the screen substantially alters the strength of the magnetic field generated by the transmit coil, in that it is, compared to the "non-screen" case, relatively weak far from the windings compared to that close to the windings.

In order to make the field more uniform across the sensitive zone, the windings need be wound in a planar spiraled fashion, such that the number of windings per unit length increases from the centre of the winding to the outside perimeter. This also applies to each receive coil winding, that is, it needs to be distributed in a similar spread-out fashion.

We claim:

1. A ball location assessment apparatus for installation beneath a surface of a playing court, said apparatus including at least one transmit coil and at least one receive coil wherein said at least one transmit coil and said at least one receive coil are selectively aligned so as to be in a mutually adjacent and overlapping position to one another beneath a pre-designated portion of said surface, each receive coil being provided for detecting the presence of a magnetically permeable ball, the orientation of said at least one receive coil relative to said at least one transmit coil being such that the at least one receive coil is substantially electrically nulled so that the net induced electro-motive force across the at least one receive coil is substantially zero with respect to alternating magnetic fields emitted from said at least one transmit coil.

2. The ball location assessment apparatus of claim 1, wherein there are two receive coils and said at least one transmit coil is electrically connected to a circuit generating an alternating electro-magnetic signal, said two receive coils being disposed adjacent to said at least one transmit coil for producing signals indicative of whether the magnetically permeable ball has hit the surface of the playing court at particular positions thereon, these particular positions defining for example the base lines of the playing court, and the signals produced by each receive coil being representative of whether the ball is "in" or "out".

3. The ball location assessment apparatus of claim 2, wherein at least one of said two receive coils is a two-portion receive coil which comprises a first portion electrically wound in a clockwise direction and a second portion electrically wound in a counter clockwise direction to substantially cancel out interference signals otherwise transmitted from far field electro-magnetic sources.

4. The ball location assessment apparatus of claim 3, wherein one of said two receive coils is a two-portion receive coil and the other is a three-portion receive coil, the three-portion receive coil comprising first and third portions electrically wound in either a clockwise or counterclockwise direction and a second portion electrically wound in an opposite direction to said first and third portions and disposed therebetween, lateral boundaries between adjoining portions of said three portion receive coil being arranged so as not to be coplanar in spatial position with the lateral boundary between adjoining portions of said two portion receive coil.

5. The ball local assessment apparatus of claim 2, wherein said at least one transmit coil is electrically connected to a circuit generating an alternating electromagnetic signal and said at least one receive coil is electrically connected to a detector circuit, said detector circuit identifying, in response to said alternating electro-magnetic signal, when a magnetically permeable ball is within a near field vicinity of one of said at least one transmit coil and a corresponding receive coil.

6. The ball location assessment apparatus of claim 5, wherein said detector circuit identifies when a magnetically permeable ball is within a near field vicinity by synchronously demodulating the alternating electromagnetic signal transmitted.

7. The ball location assessment apparatus of claim 6, wherein the alternating electro-magnetic signal is substantially sinusoidal, the detector circuit including a plurality of synchronous demodulators and low pass filters, the synchronous demodulators being made synchronous with the alternating electro-magnetic field and the respective phases being selected such that the resistive and reactive components thereof are substantially in phase and at quadrature with a resistive and a reactive component of the magnetically permeable ball at a frequency of the alternating electro-magnetic signal, and wherein the detector circuit further includes means for rejecting false signals arising from materials having reactive to resistive ratios different from that of the magnetically permeable ball.

8. The ball location assessment apparatus of claim 5, wherein the detector circuit includes processing means for determining ball position by calculating the value of the amplitude of signals received by each receive coil.

9. The ball location assessment apparatus of claim 8, wherein said processing means includes a microprocessor unit for computing an apparent trajectory of a magnetically permeable ball striking the surface of the playing court using programmed algorithms having constraining parameters related to said apparent trajectory.

10. The ball location assessment apparatus of claim 9, wherein said processing means determines whether the magnetically permeable ball has traversed near either of two ends of any receive coil in response to the signals received from said receive coils and to compute the apparent trajectory of the magnetically permeable ball as a function of whether the ball was "in" or "out".

11. The ball location assessment apparatus of claim 2, wherein there are a plurality of transmit coils selectively positioned to occupy a long length linear path beneath said surface, said transmit coils being laid end to end with a portion of each end overlapping a mutually adjacent transmit coil.

12. The ball location assessment apparatus of claim 2, wherein individual ends of each of the receive and transmit coils are spread apart.

13. The ball location assessment apparatus of claim 2, further comprising a metal screen located below said at least one receive coil and said at least one transmit coil, each said at least one receive coil and said at least one transmit coil being wound in planar spiraled fashion such that the number of windings per unit length increases from the center of each said winding to the outermost perimeter, the coil geometry and conductor density being selected to make the electro-magnetic field about the coil reasonably uniform across a coil's sensitive zone.

14. The ball location assessment apparatus of claim 1, wherein there are a plurality of receive coils selectively positioned to occupy a long length linear path beneath said surface, said receive coils being laid end to end with a portion of each end overlapping a mutually adjacent receive coil.

* * * * *